United States Patent [19]

Matteson et al.

[11] 4,349,365

[45] Sep. 14, 1982

[54] DUAL STRAND PACKAGING APPARATUS

[75] Inventors: Thomas O. Matteson, Columbus, Ohio; David C. Wingate, Amarillo, Tex.

[73] Assignee: Owens-Corning Fiberglas Corporation, Toledo, Ohio

[21] Appl. No.: 318,886

[22] Filed: Nov. 6, 1981

[51] Int. Cl.[3] ..... C03B 37/025

[52] U.S. Cl. ..... 65/10.1; 242/18 G

[58] Field of Search ..... 65/1, 2, 10.1

[56] References Cited

U.S. PATENT DOCUMENTS

| | | | |
|---|---|---|---|
| 2,846,157 | 8/1958 | Stephens et al. | 65/10.1 |
| 3,334,980 | 8/1967 | Smith | 65/2 |
| 3,512,725 | 5/1970 | Smith et al. | 65/10.1 |
| 3,693,896 | 9/1972 | Brauweiler et al. | 65/10.1 |
| 4,130,248 | 12/1978 | Hendrix et al. | 242/18 G |

FOREIGN PATENT DOCUMENTS

| | | | |
|---|---|---|---|
| 1557829 | 1/1969 | France | 65/10.1 |

*Primary Examiner*—Robert L. Lindsay, Jr.

*Attorney, Agent, or Firm*—Ronald C. Hudgens; Philip R. Cloutier; Paul J. Rose

[57] ABSTRACT

Dual strand packaging apparatus including an indexible turret having two winding collets rotatably mounted thereon, an elongated bushing above the collets with a longer dimension extending transversely of the collets, the bushing supplying molten glass streams for attenuation into glass filaments, gathering shoes disposed in a manner enabling filaments at the bushing to be divided equally into front and rear groups and the groups gathered respectively into front and rear strands for winding into front and rear packages on front and rear winding sleeves on a collet in operating position, a strand push-off blade advanceable and retractable along a collet in the operating position and constructed to trap the front and rear strands while in advanced position upon indexing of the turret and while retracting to pull both strands to the rear of a collet moved to operating position upon indexing of the turret, and a strand release blade for moving the front and rear strands out of the push-off blade as the push-off blade reaches retracted position.

6 Claims, 15 Drawing Figures

DUAL STRAND PACKAGING APPARATUS

TECHNICAL FIELD

The invention disclosed herein relates generally to dual strand packaging apparatus, and more particularly to an improved means of controlling transfer of the advancing strands as they are being collected in a multi-collet, continuous process.

BACKGOUND ART

Dual collet, dual package strand packaging apparatus generally similar to that disclosed herein is illustrated in U.S. Pat. Nos. 4,057,195, issued to Jones et al. on Nov. 8, 1977, and 4,300,728, to be issued to Andre et al. on Nov. 17, 1981. In the apparatus of each of these patents and of this application, glass filaments attenuated from molten glass streams supplied by an elongated, electrically heated stream feeder or bushing are gathered into two groups and formed into two strands by a pair of gathering shoes, the strands are wound into two packages on one of a pair of rotatably indexible collets, and the long dimension of the bushing extends transversely of the collets. However, in the apparatus of the patents, the filaments are divided into two groups disposed respectively on opposite sides of an imaginary vertical plane extending transversely of the bushing and the gathering shoes are aligned in a direction extending transversely of the collets and longitudinally of the bushing, while in the apparatus of this application, the filaments are divided into two groups disposed respectively on opposite sides of an imaginary vertical plane extending longitudinally of the bushing and the gathering shoes are aligned in a direction extending longitudinally of the collets and transversely of the bushing. If any variations in temperature occur in the bushing, they would most likely occur along the length of the bushing, and splitting the filaments transversely of the bushing into the two groups could result in filaments of different size in the two packages and packages of different size. Splitting the filaments longitudinally of the bushing into the two groups tends to distribute any filaments of different size evenly between the two packages to keep the packages the same in size.

Our invention relates, then, to apparatus in which two strands are wound respectively into two packages on one of a pair of rotatably indexible collets, the strands being formed respectively from filaments divided into two groups disposed respectively on opposite sides of an imaginary vertical plane extending longitudinally of the bushing, and the groups being drawn respectively through gathering shoes aligned in a direction extending longitudinally of the collets and transversely of the bushing.

Prior to our invention, when the two packages on the operating collet were finished being wound, a push-off blade was extended to move the two strands off the packages and into a groove at the front of the collet for temporary winding as scrap. The turret carrying the collets was then indexed to move the finished packages to an unloading position, move an empty collet with freshly installed winding sleeves into operating position, and pick up the strands in the front groove of the empty collet. When the empty collet reached the winding position, the push-off blade was retracted. Because the gathering shoes were positioned in alignment respectively with the midpoints of the lengths of the packages to be formed, after the push-off blade was retracted, the strands moved out of the front groove due to their own weight and centered themselves respectively at the midpoints of the lengths of the packages to be formed. Then the package builder moved into position and the two reciprocating strand guides picked up the respective strands for the formation of new packages. The operation was successful most of the time, but problems remained.

When the push-off blade retracted, the time it took for the strands to move out of the collet groove and center themselves respectively at the midpoints of the winding sleeves varied depending on the stickiness of the binder being used, temperature, humidity, etc. If it took too long for the rear strand, both strands would be picked up by the front strand guide of the builder. If more time was allowed for the builder to advance and both strands moved into proper winding positions promptly, narrow hands of wound strand would form at the longitudinal centers of the winding sleeves before the builder advanced and cause fluttering of the strand guides of the builder, resulting in unacceptable packages.

DISCLOSURE OF INVENTION

In accordance with the invention, a push-off blade is provided which captures both strands as the collet turret is rotated after the push-off blade has advanced. Both strands are pulled out of the front groove of the collet when the push-off blade retracts and are released from the push-off blade, as the push-off blade reaches fully retracted position, by a stationary strand release blade. The strands then align themselves respectively with the midpoints of the lengths of the winding sleeves and the package builder advances to pick up the strands in the respective strand guides. The release of the captured strands from the push-off blade is more positively controlled than the movement of the strands out of the groove at the front of the collet in the former method of operation. Therefore, the package builder can be advanced promptly to prevent initial buildup of windings at the midpoints of the sleeves and at the same time the trapping of both strands in the front strand guide of the builder is eliminated.

BRIEF DESCRIPTION OF DRAWINGS

The invention is described hereinafter in greater detail with reference to the accompanying drawings in which.

BEST MODE OF CARRYING OUT THE INVENTION

Figure 1:
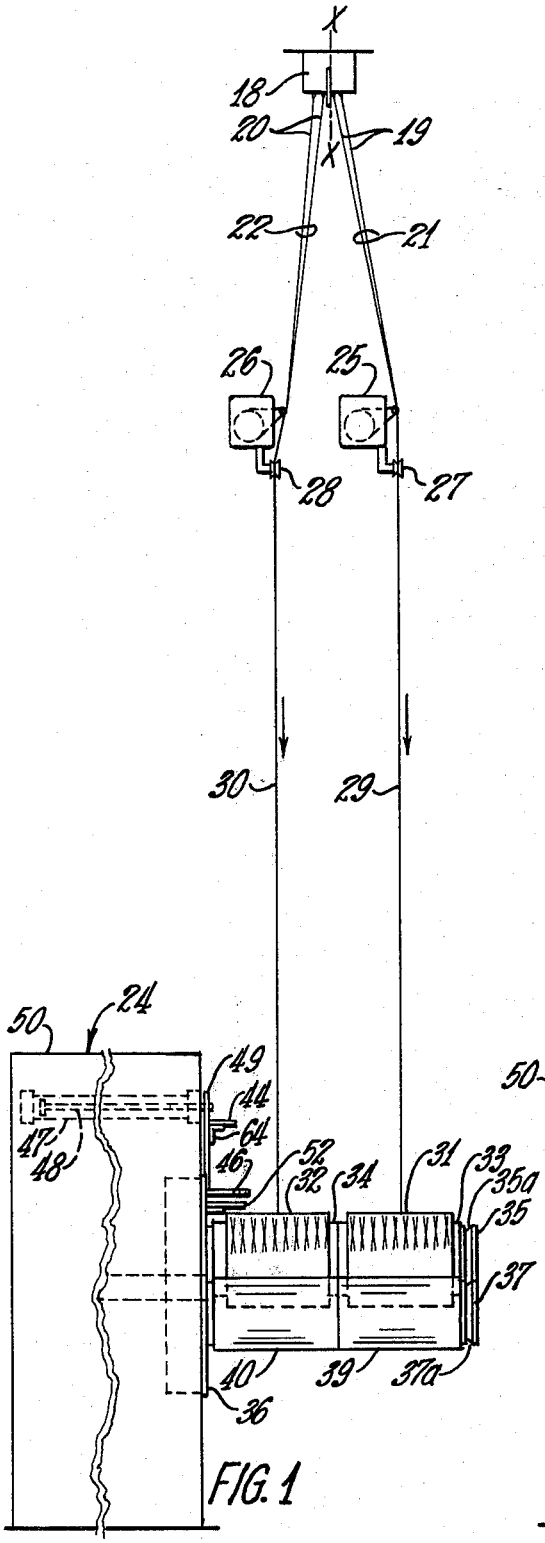
FIG. 1 is a left-hand side elevational view of dual strand packaging apparatus constructed in accordance with the invention.
Figure 2:
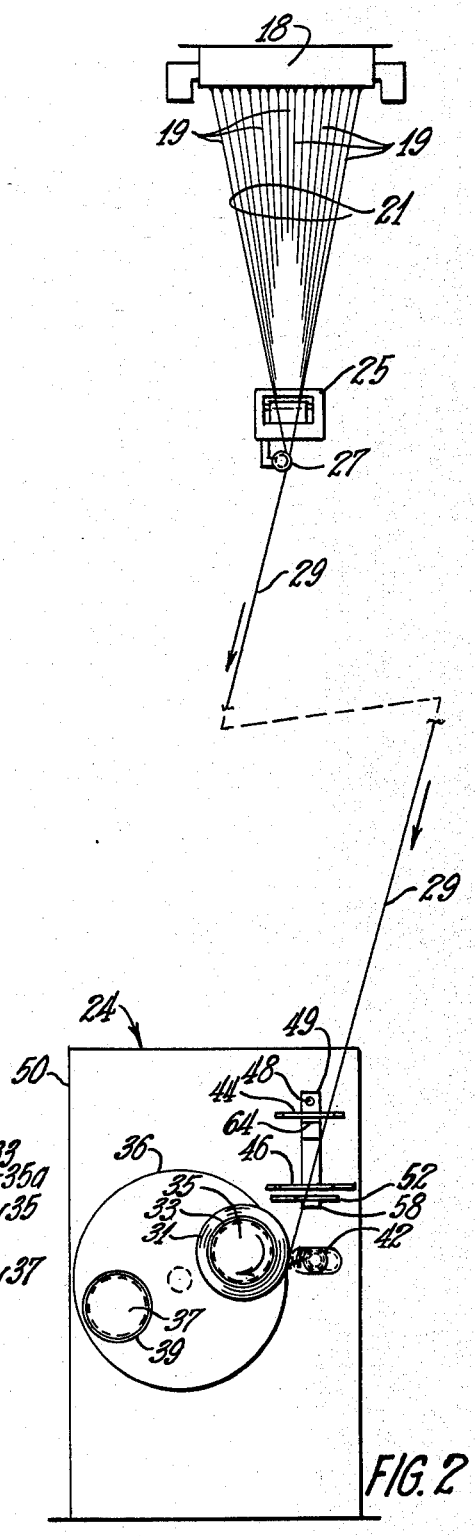
FIG. 2 is a front elevational view of the apparatus of FIG. 1.

With respect to the drawings, FIGS. 1 and 2 show an elongated, electrically heated stream feeder or bushing 18 with an orificed bottom wall supplying molten glass streams for attenuation into glass filaments 19 and 20 through the action of an automatic winder 24 in a manner known in the art. In accordance with this invention, the filaments 19 and 20 are separated into front and rear groups 21 and 22 disposed respectively on opposite sides of an imaginary central vertical plane extending longitudinally of the bushing 18 and indicated by the line X—X in FIG. 1. Conventional applicators 25 and 26 are provided to apply sizing respectively to the filaments 19 and 20 before the groups 21 and 22 thereof are drawn respectively through gathering shoes 27 and 28 to form strands 29 and 30. The strands 29 and 30 are wound into front and rear packages 31 and 32 respectively on front and rear winding sleeves 33 and 34 disposed on an operating collet 35 rotatably mounted on a rotatably indexible turret 36 of the winder 24. A standby collet 37 is rotatably mounted on the turret 36 diametrically opposite the collet 35 and is provided with freshly installed winding sleeves 39 and 40. Driving means for the collets 35 and 37 and the turret 36 may be generally as shown in U.S. Pat. No. 4,052,015.

A package builder 42 (FIG. 2) such as shown in U.S. Pat. No. 3,897,021 is mounted for movement toward and away from the collet 35 and includes a helically grooved rotatably driven barrel cam reciprocally driving front and rear strand guides for respectively moving the front and rear strands 29 and 30 back and forth along the collet 35 to build the packages 31 and 32.

The front end portions of the collets 35 and 37 are provided respectively with annular grooves 35*a* and 37*a* for temporarily winding strands, such as the strands 29 and 30, as scrap to be removed and discarded when a collet is in the standby position shown by the collet 37 in FIGS. 1 and 2. The grooves are preferably provided with strand-trapping pins as more fully disclosed in U.S. Pat. No. 4,057,195.

A strand guide blade 44 and a strand push-off blade 46 are reciprocally moved between advanced and retracted positions by a pneumatic actuator 47 having a piston rod 48 threadedly received in a mounting plate 49 for the blades. The actuator 47 is mounted in a housing 50 of the winder 24. A stationary strand release blade 52 is mounted on a front wall of the housing 50 just below the retracted position of the push-off blade 46. The strand guide blade 44 prevents abrasion of the strands 29 and 30 on the mounting plate 49.

Figure 3:
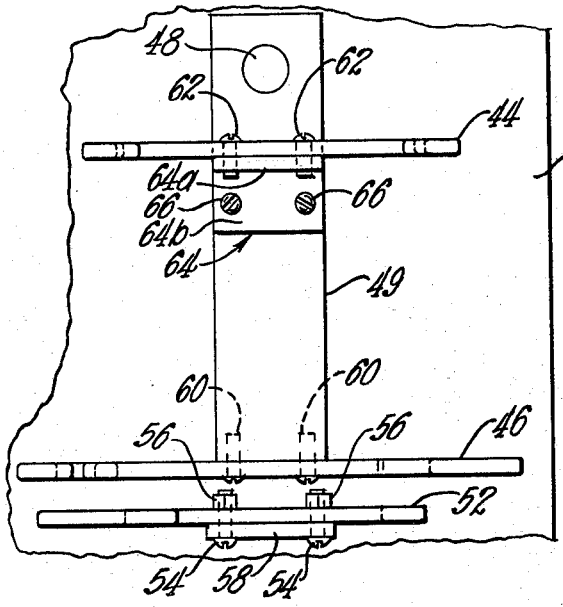
FIG. 3 is a front elevational view of a reciprocally mounted guide blade and push-off blade assembly and a stationary strand release blade therebelow, the blades forming parts of the apparatus of FIGS. 1 and 2.
Figure 4:
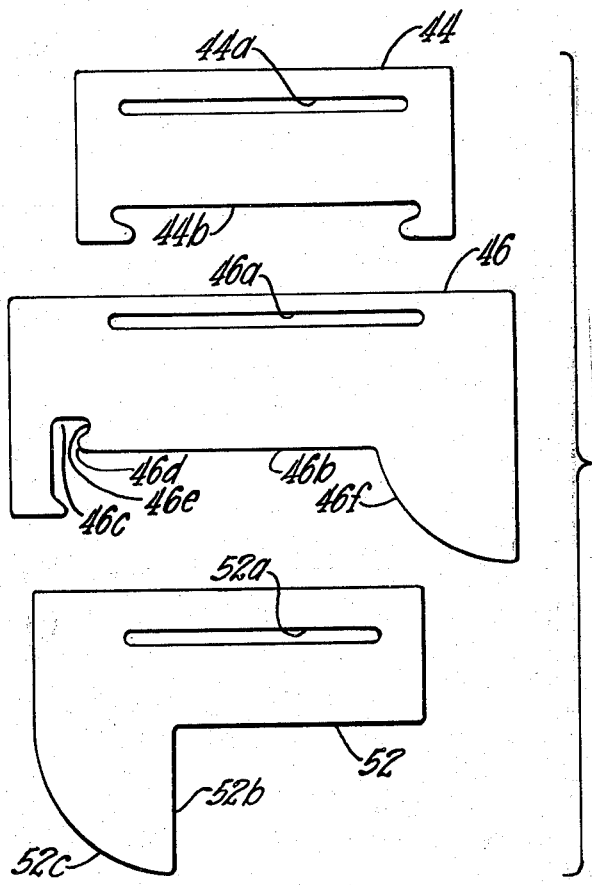
FIG. 4 is a plan view of the blade members of FIG. 3, the blade members being shown separately before assembly thereof with the rest of the apparatus of FIGS. 1 and 2.

The blade members 44, 46 and 52 are shown in greater detail in FIGS. 3 and 4. They are provided respectively with slots 44*a*, 46*a*, and 52*a* for adjustable mounting thereof. Two screws 54 provided respectively with nuts 56 adjustably secure the strand release blade 52 to a flat support member 58 provided on the front wall of the housing 50. Two screws 60 adjustably secure the strand push-off blade 46 directly to the lower end surface of the mounting plate 49. Two screws 62 adjustably secure the strand guide blade 44 to a horizontal leg portion 64*a* of an L-shaped bracket 64. Two screws 66 fixedly secure a vertical leg portion 64*b* of the bracket to the mounting plate 49.

The strand guide blade 44 is recessed to provide a straight guide surface 44*b* extending nearly all the way across the front thereof. The strand push-off blade 46 is provided at the front with a straight guide surface 46*b* of about the same length as the guide surface 44*b*. Adjacent the left-hand end of the straight guide surface 46*b* as viewed in FIG. 4, the blade 46 is provided with a generally L-shaped notch 46*c* providing a leftwardly extending projection 46*d* partially defining a leftwardly opening pocket 46*e*. If desired, the blade 46 may also be provided, at its right-hand end as viewed in FIG. 4, with a cam surface 46*f* not normally having any contact with the strands 29 and 30. The strand release blade 52 is provided with a frontwardly extending projection 52*b* providing a cam surface 52*c* which moves the strands 29 and 30 out of the pocket 46*e* as the push-off blade 46 is retracted.

Figure 5:
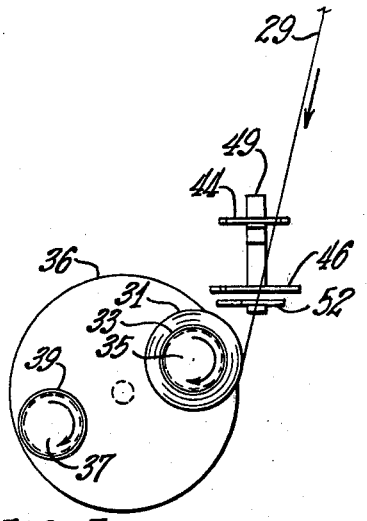
FIGS. 5 and 6 are fragmentary front elevational and plan views, respectively, showing an operating winding collet of the apparatus of FIGS. 1 and 2 with completed packages of strand thereon but with the strand guide blade and push-off blade still in retracted position.
Figure 6:
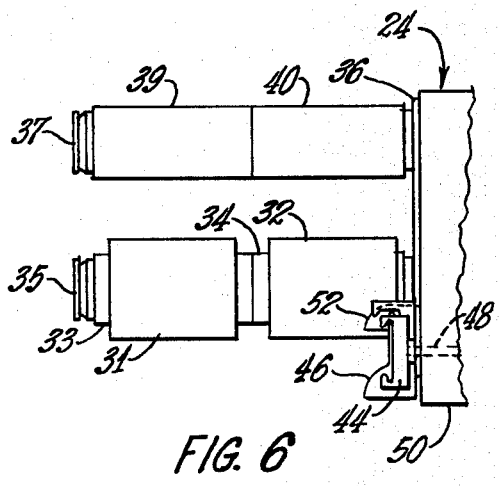

The sequence of operations may be best explained with reference to FIGS. 5–15, wherein the package builder 42 is omitted. In FIGS. 5 and 6, previously wound packages have been removed from the collet 37, empty winding sleeves 39 and 40 have been installed thereon, and scrap windings have been removed from the groove 37*a*. An operator does these chores as the packages 31 and 32 are being formed. The packages 31 and 32 can be considered complete in FIGS. 5 and 6, with the guide blade 44 and the push-off blade 46 about to advance and the turret 36 about to index, the collet 37 having already started rotating. The strands 29 and 30 are not shown in FIG. 6, because they would still be moving back and forth respectively along the packages 31 and 32.

Figure 7:
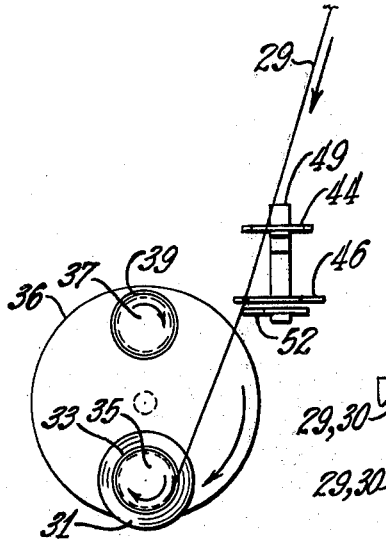
FIGS. 7 and 8 are views similar to FIGS. 5 and 6, respectively, but showing a rotatably indexible turret for the collets partially indexed and the strand guide blade and push-off blade in extended position.
Figure 9:
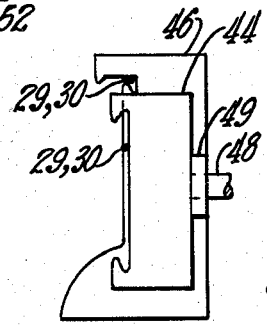
FIG. 9 is an enlarged fragmentary view of the guide blade and push-off blade portion of FIG. 8 showing the positions of the strands with respect thereto when the collet turret is in the position shown in FIG. 7.
Figure 8:
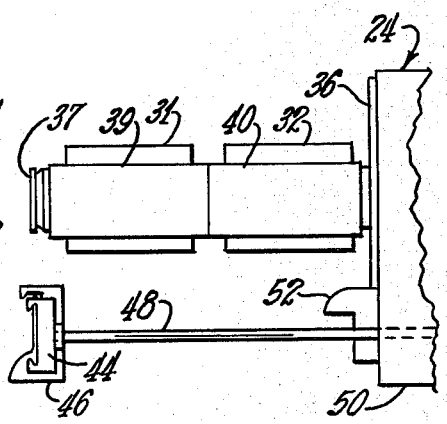

In FIGS. 7–9, the strand guide blade 44 and the strand push-off blade 46 have advanced and pushed the strands 29 and 30 into the front groove 35*a* of the collet 35, and the turret 36 has partially indexed. Once the blades 44 and 46 have advanced, the strands 29 and 30 run as one strand from the guide blade 44 to the groove 35*a*. Both the movement of the strands 29 and 30 from the packages 31 and 32 into the groove 35*a* and the indexing of the turret 36 to move the collet 35 from the position of FIG. 5 to the position of FIG. 7 cause movement of the strands to the left as viewed therein. During this leftward movement, the strands 29 and 30 move along the guide surface 44*b* of the strand guide blade 44 to the position shown in FIG. 9, and along the guide surface 46*b* of the strand push-off blade 46 and into the notch 46*c* (FIG. 4) to the position shown in FIG. 9.

Figure 10:
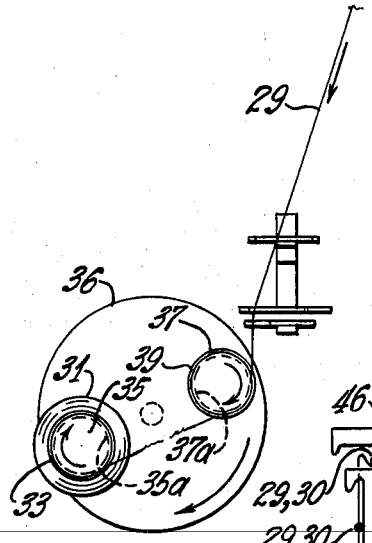
FIGS. 10, 11 and 12 are views similar to FIGS. 7, 8 and 9, respectively, but with the collet turret fully indexed in FIG. 10 and with the corresponding strand positions relative to the blade members shown in FIG. 12.
Figure 12:
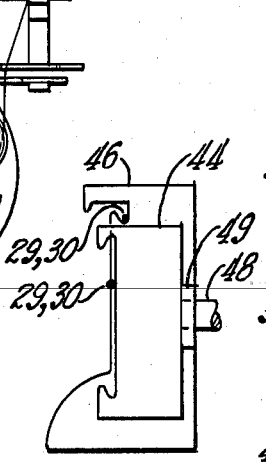
Figure 11:
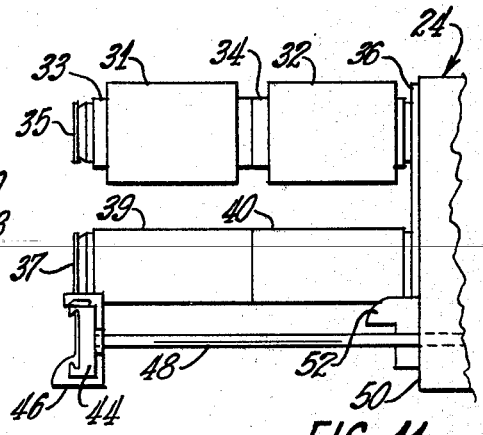

In FIGS. 10–12, the turret 36 has completed indexing and the strands 29 and 30 have been picked up in the groove 37*a* of the standby collet 37. The finished package collet 35 is being braked to a stop, but while it is still rotating, the portion of the strands 29 and 30 between the collets is broken. The movement of the collet 37 from the position of FIG. 7 to the position of FIG. 10 moves the strands 29 and 30 somewhat to the right as viewed therein and into the pocket 46*e* (FIG. 4) of the strand push-off blade 46, as indicated in FIG. 12, which also shows the position of the strands 29 and 30 with respect to the guide blade 44.

Figure 13:
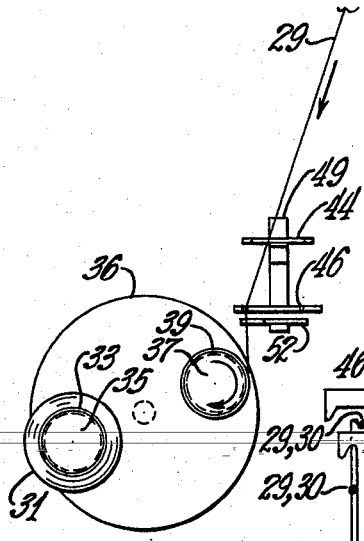
FIGS. 13, 14 and 15 are views similar to FIGS. 10, 11 and 12, respectively, but showing the finished package collet in stationary condition ready for the removal of the finished packages and the installation of new empty winding sleeves thereon.
Figure 15:
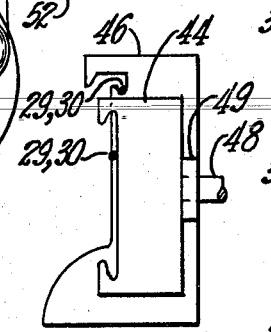
Figure 14:
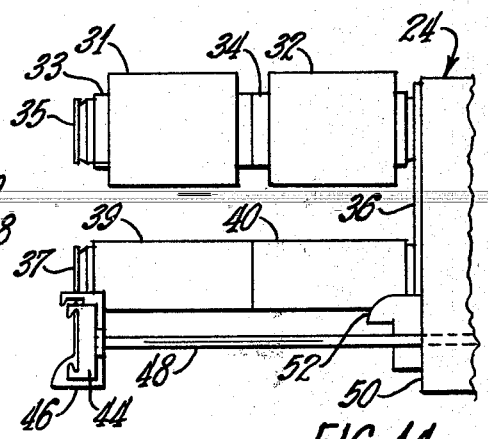

In FIGS. 13–15, the collet 35 has stopped rotating. The operator can then remove the packages 31 and 32 with their winding sleeves 33 and 34, install standby empty winding sleeves, and remove the scrap windings from the groove 35*a* while new packages are being built up on the winding sleeves 39 and 40 on the collet 37. From the position thereof shown in FIG. 14, the guide blade 44 and the push-off blade 46 are retracted back to the position thereof shown in FIG. 6. Because of the projection 46*d* (FIG. 4), the strands 29 and 30 remain in the pocket 46*e* until they are pushed out therefrom upon contact with the cam surface 52*c* of the strand release blade 52 during the last stage of the retraction of the blades 44 and 46. Upon release from the pocket 46*e*, the strands 29 and 30 center themselves respectively at the midlengths of the winding sleeves 39 and 40 and the builder 42 advances to pick up the strands respectively in the front and rear strand guides thereof and start building-up the new packages.

The controlled release of the strands 29 and 30 from the pocket 46*e* of the push-off blade 46 by the strand release blade 52 is more reliable than the relatively uncontrolled movement of the strands out of the annular front groove of the collet in the former method of operation and the advance of the package builder 42 can thus be more accurately timed. The occasional trapping of both strands in the front strand guide of the builder as well as the occasional premature buildup of windings at the midlengths of the winding sleeves in the former method of operation have been eliminated by the structure of this invention.

Various modifications may be made in the structure shown and described without departing from the spirit and scope of the invention.

We claim:

1. Dual strand packaging apparatus comprising a rotatably indexible turret, a pair of spaced, parallel elongated winding collets each rotatably mounted on the turret and movable alternatively into operating and standby positions oppositely to the other upon indexing of the turret, each collet being adapted to receive front and rear strand winding sleeves for the buildup of front and rear strand packages respectively thereon while the collet is in the operating position and each collet having a front annular groove for temporarily receiving scrap strand windings, an elongated bushing disposed above the turret and collets for supplying molten glass streams for attenuation respectively into glass filaments by the winding action of a collet in the operating position, a longer dimension of the bushing extending transversely of the collets, front and rear gathering shoes disposed between the bushing and the collets in a manner enabling the filaments at the bushing to be divided equally into front and rear groups disposed respectively to the front and rear of an imaginary vertical plane extending longitudinally of the bushing and the filaments of the front and rear groups to be drawn respectively through the front and rear gathering shoes to form front and rear strands, the front and rear strands being adapted to be wound respectively into front and rear strand packages respectively on front and rear strand winding sleeves on a collet in the operating position, a strand push-off blade advanceable and retractable along a collet in the operating position, and a stationary strand release blade adjacent the strand push-off blade in a retracted position thereof, the strand push-off blade and the strand release blade being so constructed and arranged that (a) when the strand push-off blade is advanced upon completion of front and rear packages on a collet in the operating position, the front and rear strands are moved from the packages for temporary winding in the front annular groove of the collet, (b) when the turret is indexed with the strand push-off blade in advanced position, both the front and rear strands are trapped in the strand push-off blade, and (c) when the strand push-off blade is retracted, both the front and rear strands are pulled out of the front annular groove of the collet indexed to the operating position when the turret is indexed to trap the strands in the strand push-off blade, moved to the rear of the collet, and released from the strand push-off blade upon contact with the strand release blade.

2. Dual strand packaging apparatus as claimed in claim 1 wherein the front and rear gathering shoes are aligned respectively with the midlengths of front and rear strand packages being formed on a winding collet in the operating position when viewed in a direction extending transversely of the collets.

3. Dual strand packaging apparatus as claimed in claim 1 wherein the front and rear gathering shoes are aligned with each other when viewed in a direction extending longitudinally of the winding collets.

4. Dual strand packaging apparatus as claimed in claim 1 wherein the front and rear gathering shoes are aligned with each other when viewed in a direction extending longitudinally of the winding collets and are aligned respectively with the midlengths of front and rear strand packages being formed on a winding collet in the operating position when viewed in a direction extending transversely of the collets.

5. Dual strand packaging apparatus as claimed in claim 1 wherein the strand push-off blade is provided with a straight, front, horizontally extending strand guide surface for contacting the front and rear strands when the push-off blade is advanced and with a generally L-shaped notch adjacent an end of the straight front strand guide surface closer to the winding collets, the L-shaped notch providing a pocket opening toward the winding collets for trapping the front and rear strands when the turret is indexed and while the push-off blade is retracted.

6. Dual strand packaging apparatus comprising a rotatably indexible turret, a pair of spaced, parallel, elongated winding collets each rotatably mounted on the turret and movable alternatively into operating and standby positions oppositely to the other upon indexing of the turret, each collet being adapted to receive front and rear strand winding sleeves for the buildup of front and rear strand packages respectively thereon while the collet is in the operating position and each collet having a front annular groove for temporarily receiving scrap strand windings, an elongated bushing disposed above the turret and collets for supplying molten glass streams for attenuation respectively into glass filaments by the winding action of a collet in the operating position, a longer dimension of the bushing extending transversely of the collets, horizontally spaced front and rear gathering shoes disposed between the bushing and the collets in a manner enabling the filaments at the bushing to be divided equally into front and rear groups disposed respectively to the front and rear of an imaginary vertical plane extending longitudinally of the bushing and the filaments of the front and rear groups to be drawn respectively through the front and rear gathering shoes to form front and rear strands, the front and rear strands being adapted to be wound respectively into front and rear strand packages respectively on front and rear winding sleeves on a collet in the operating position, the front and rear gathering shoes being aligned with each other when viewed in a direction extending longitudinally of the winding collets and being aligned respectively with the midlengths of front and rear strand packages being formed on a winding collet in the operating position when viewed in a direction extending transversely of the collets, a strand push-off blade advanceable and retractable along a collet in the operating position, and a stationary strand release blade adjacent the strand push-off blade in a retracted position thereof, the strand push-off blade and the strand release blade being so constructed and arranged that (a) when the strand push-off blade is advanced upon completion of front and rear packages on a collet in the operating position, the front and rear strands are moved from the packages for temporary winding in the front annular groove of the collet, (b) when the turret is indexed with the strand push-off blade in advanced position, both the front and rear strands are trapped in the strand push-off blade, and (c) when the strand push-off blade is retracted, both the front and rear strands are pulled out of the front annular groove of the collet indexed to the operating position when the turret is indexed to trap the strands in the strand push-off blade, moved to the rear of the collet, and released from the strand push-off blade upon contact with the strand release blade, the strand push-off blade being provided with a straight, front, horizontally extending strand guide surface for contacting the front and rear strands when the push-off blade is advanced and with a generally L-shaped notch adjacent an end of the straight front strand guide surface closer to the winding collets, the L-shaped notch providing a pocket opening toward the winding collets for trapping the front and rear strands when the turret is indexed and while the push-off blade is retracted.

* * * * *